US006227890B1

(12) United States Patent
Roper, Jr. et al.

(10) Patent No.: US 6,227,890 B1
(45) Date of Patent: May 8, 2001

(54) SERVICE ENTRANCE UNIT WITH GENERATOR INTERFACE

(75) Inventors: Lawrence T. Roper, Jr., Buford; Philip Buckman, Roswell, both of GA (US)

(73) Assignee: Antec Corporation, Duluth, GA (US)

( * ) Notice: Subject to any disclaimer, the term of this patent is extended or adjusted under 35 U.S.C. 154(b) by 0 days.

(21) Appl. No.: 09/514,218

(22) Filed: Feb. 25, 2000

(51) Int. Cl.[7] ..... H01R 27/00
(52) U.S. Cl. ..... 439/218; 361/641
(58) Field of Search ..... 439/218, 221; 361/641, 644

(56) References Cited

U.S. PATENT DOCUMENTS 2,288,241 * 6/1942 Holcomb .
3,341,268 * 9/1967 Bickford .
5,486,664 * 1/1996 Lamp et al. ..... 200/297
5,932,939 * 8/1999 Simmons ..... 307/326

* cited by examiner

*Primary Examiner*—Lincoln Donovan
*Assistant Examiner*—Thanh-Tâm Lê
(74) *Attorney, Agent, or Firm*—Troutman Sanders LLP; Wm. Brook Lafferty, Esq.

(57) ABSTRACT

A service entrance unit includes a generator connection space to allow an alternate power source, such as a generator, to be connected to a load line within the unit. The unit includes a body and a cover to enclose the interior of the unit. The interior of the unit includes a faceplate which has a receptacle that receives utility power, and a load is connected to utility power by a load plug mated with the faceplate receptacle. The faceplate does not extend the full height of the body, thereby leaving a generator connection space in the interior. When utility power is interrupted, the load plug is disconnected from the faceplate receptacle and a generator is connected to the load by connecting a generator cord receptacle to the load plug. This connection is positioned in the generator connection space, the generator power cord extends from cutouts in the unit, and the cover of the unit is closed to secure the connection.

10 Claims, 3 Drawing Sheets

SERVICE ENTRANCE UNIT WITH GENERATOR INTERFACE

FIELD OF THE INVENTION

The invention relates generally to electrical service entrances and, more specifically, to a service entrance that provides adequate space for the connection of an alternative energy source to a load.

BACKGROUND OF THE INVENTION

In communications networks, such as cable television systems, electrical power is required to operate various equipment, such as amplifiers, within the system. Power supplies are located throughout the system to provide the desired power to the equipment located throughout the system. The power supplies typically receive power from the utility power lines and convert that power to a type that is suitable for operating the various communications equipment, as is well known to those skilled in the art. Power supplies also typically include batteries to provide back-up power to the power supplies when utility power is interrupted.

However, the batteries in power supplies only provide back-up power for a relatively short time, typically only a couple hours. For longer utility power outages, the batteries are incapable of providing adequate back-up power, which would cause an interruption of service to downstream subscribers. Therefore, when a long utility power interruption occurs, an alternate power source such as a generator is typically connected directly to the power supply to provide power until utility power is restored.

The power supply, or any other load that is powered by utility power, typically has a receptacle therein. The power supply receptacle is typically connected to the utility power via a line running from a service entrance, which is in turn connected to the utility power line. A service entrance, as is known to those skilled in the art, is a device that is used to land utility power, and typically includes circuit breakers that are connected on one side to the utility power line, and on the other side to the load. In this manner, the utility power can be disconnected from the power supply by flipping the circuit breaker, much in the same way as is done in residential homes when a homeowner wants to disconnect power from a circuit in the dwelling.

There are numerous disadvantages associated with connecting a generator directly to a power supply. A generator power cord must be run from the generator and connected to a receptacle inside the power supply. To connect the generator power cord to the power supply, the door or cover of the power supply must be opened to provide access to the receptacle inside the power supply. To connect the generator power cord to the power supply, the line running from the service entrance to the power supply is disconnected from the power supply receptacle within the power supply, and the generator power cord is plugged into the power supply receptacle. Not only is accessing the interior of the load difficult, but the generator power cord prevents the door to the power supply from completely closing after the generator is connected to the power supply, thereby exposing the interior of the power supply to environmental conditions and preventing the power supply from being securely locked.

Therefore, there is a need in the art for a service entrance that allows a load, such as a power supply, to be connected to an alternate energy source, such as a generator, without having to access and enter the load device.

SUMMARY OF THE INVENTION

The present invention is a service entrance unit that includes a generator connection space to allow an alternate power source, such as a generator, to be connected to a load line within the unit. The service entrance unit includes a body and a cover hingedly attached to the body to enclose the interior of the unit. The interior of the unit includes a faceplate, which has circuit breakers and a receptacle thereon for receiving utility power. The faceplate extends outwardly a certain distance from the back wall of the body to allow electrical connections to be made, behind the faceplate, to the circuit breakers and the receptacle. Preferably, the faceplate does not extend the full height of the body, thereby leaving a space in the interior of the unit. This generator connection space is preferably the space between the bottom of the body and the lower edge of the faceplate.

A utility line and a load line enter the unit, preferable through apertures in the body of the unit. The load line is electrically connected to a cord that has a plug on the end that can be mated with the faceplate receptacle to establish an electrical connection to supply utility power to the load. When utility power is interrupted and an alternate power source, such as a generator, is desired to be connected to the load, the cover is opened and the load plug is unplugged from the faceplate receptacle. A power cord is routed from a generator to the service entrance unit. The generator power cord has a receptacle on one end that is mated with the load plug, which connects generator power to the load without having to access the load. The connection between the generator cord receptacle and the load plug is positioned in the generator connection space in the interior of the unit. The cover can then be closed with the generator power cord extending through the aperture defined by corresponding cut outs on the bottom of the body and the bottom lip of the cover, respectively. The cover can then be secured, if desired, by using a padlock or other suitable locking device in the mating security tabs extending from the bottom of the body and the cover, respectively.

DETAILED DESCRIPTION

Figures 1, 2:
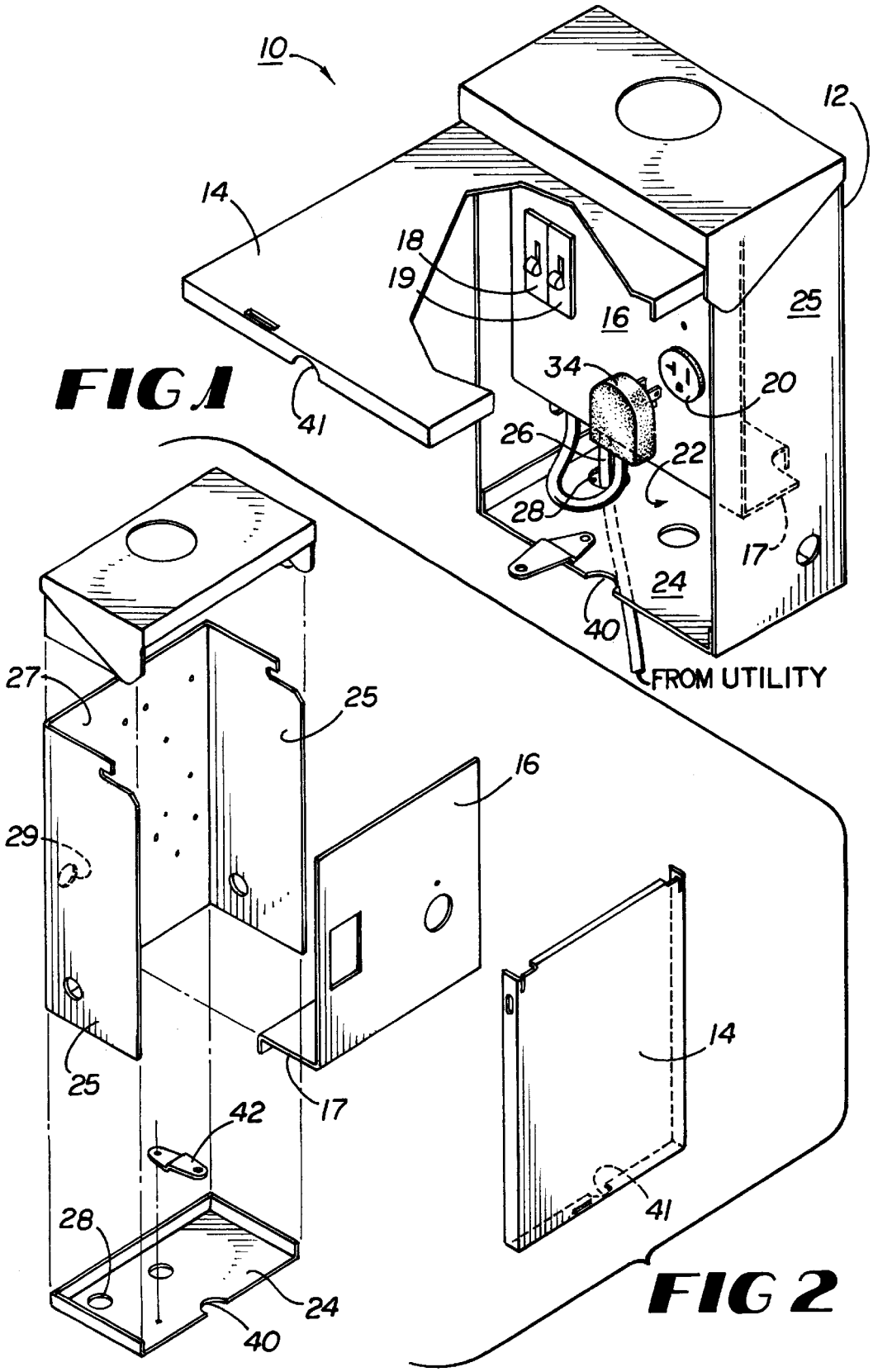
FIG. 1 is a perspective view of a service entrance unit in accordance with the present invention.
FIG. 2 shows various components of the service entrance unit.

The present invention is a service entrance unit with a generator interface. As best shown in FIGS. 1–4, the service entrance unit 10 includes a body 12 and a cover 14 hingedly attached to the body to enclose the interior of the unit. The interior of the unit includes a faceplate 16 which has a utility circuit breaker 18, a load circuit breaker 19, and a receptacle 20 thereon. The faceplate is mounted in the interior so that it is positioned outwardly a certain distance from the back wall of the body to allow electrical connections to be made, behind the faceplate, to the circuit breakers and the receptacle, as will be described below.

Preferably, the faceplate 16 does not extend the full height of the body, thereby leaving a space 22 in the interior of the unit. The space, hereafter called the generator connection space, is preferably the space between the bottom 24 of the body and the lower edge 17 of the faceplate, but the space can located at any other suitable location within the interior of the unit. For example, the generator connection space could be between the upper edge of the faceplate and top of the body, or between the side of the faceplate and the side of the body. Additionally, it is possible for the faceplate to extend the entire height and width of the body and the space could be between the faceplate and the cover of the unit when the cover is closed. As will be appreciated by those skilled in the art, the body and faceplate can be dimensioned to provide a space at any of a number of suitable locations within the interior of the service entrance unit, in accordance with the present invention. Additionally, it is possible to eliminate the faceplate and instead provide a bracket or other structural member for holding the circuit breakers, receptacle, and other items within the interior of the unit. Thus, it should be understood that while the faceplate provides a single surface on which to mount the circuit breakers and receptacle and to cover wiring and connections in the interior of the unit, the circuit breakers and receptacle can be provided in the interior of the unit in many different arrangements within the spirit and scope of the invention.

Figure 5:
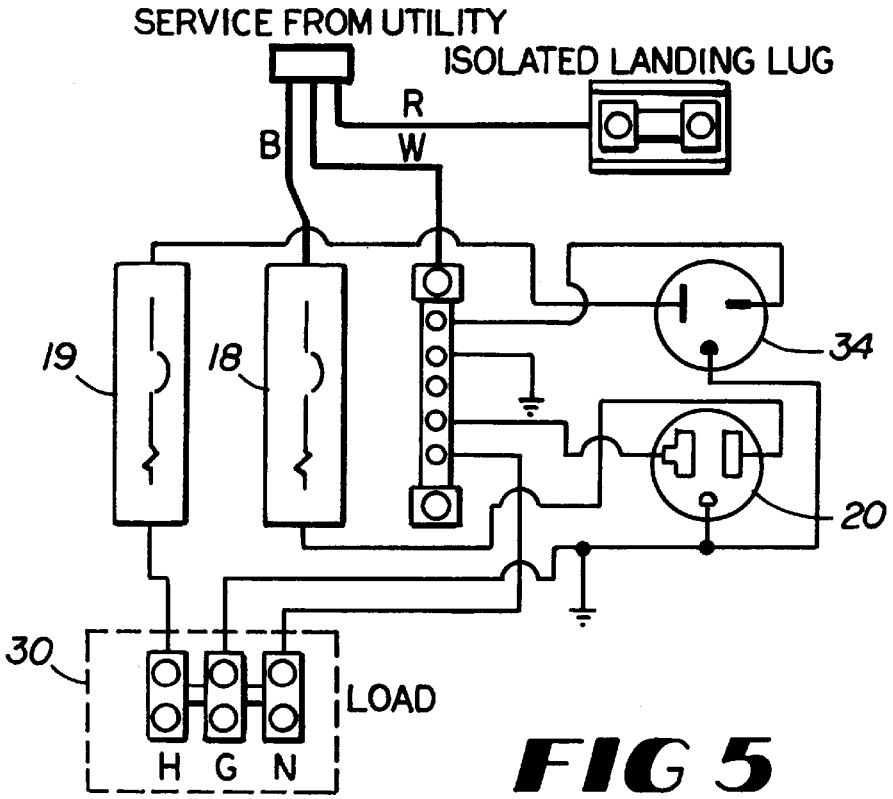
FIGS. 5 and 6 are diagrams showing the electrical connections made in the service entrance unit of the present invention for 120 volt and 240 volt applications, respectively.
Figure 6:
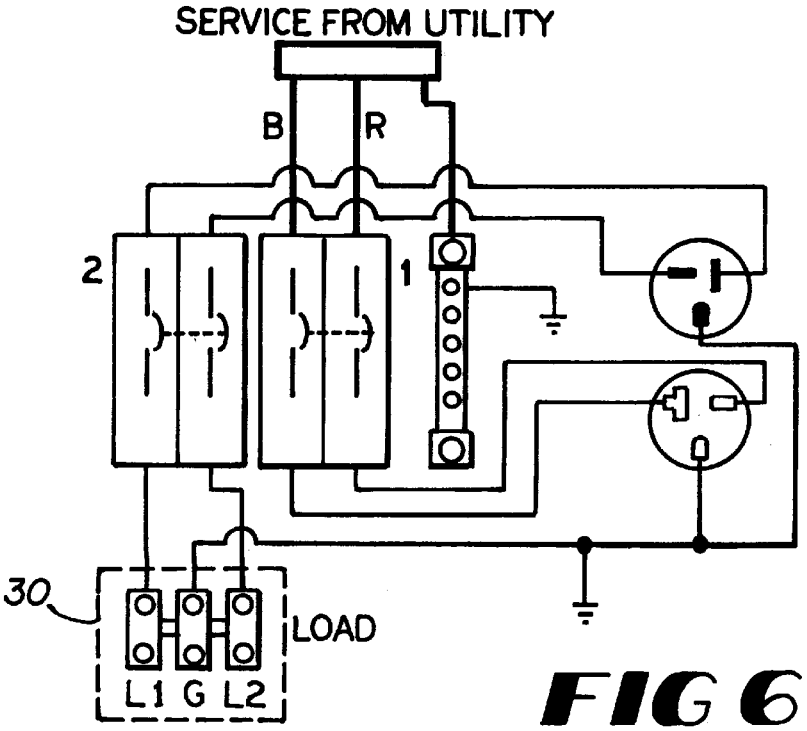

The bottom 24, sides 25, and back wall 27 of the body have apertures therein for allowing wires or cables therethrough, as best shown in FIG. 2. The back wall has apertures therein to allow the back wall to be mounted on a pole or any other suitable object using appropriate hardware. FIG. 1 shows a utility line 26 from the utility power source entering the unit. Preferably, the utility line 26 is routed upwardly through aperture 28 and routed behind the faceplate. The utility line is connected to utility circuit breaker 18 behind the faceplate and electrical connections are made between the utility circuit breaker 18 and the faceplate receptacle 20 in a manner known to those skilled in the art, thereby providing utility power to the faceplate receptacle. Diagrams of the electrical connections are shown in FIGS. 5 and 6.

A load line (not shown) is electrically connected on one end to the load and the other end is routed into the interior of the unit, preferably through aperture 29 in the back wall of the unit. The load line is electrically connected to a landing lug 30 (not mechanically shown in FIGS. 1–4, but shown in the diagrams in FIGS. 5 and 6) in the interior of the unit behind the faceplate. Although the load line is preferably routed into the unit through the back wall, the load line can be introduced into the unit in any other suitable manner, such as through apertures in the top, sides, or bottom of the unit. Preferably, the service entrance unit is installed with its back wall against the wall of the load device or a pole near the load device, thus keeping the length of the load line relatively short and making it easy to route the load line through the aperture in the back wall of the unit. It will be understood that the utility line and the load line can be routed through any suitable aperture, either in the bottom, side, or other portion of the unit, but routing lines through the bottom is advantageous because it helps to prevent water and other environmental elements from entering the interior of the unit. It will be further understood that the load is preferably a power supply for use in a communications system, although the load can be any other load for which an alternative source of power is desired when utility power is interrupted.

Figure 3:
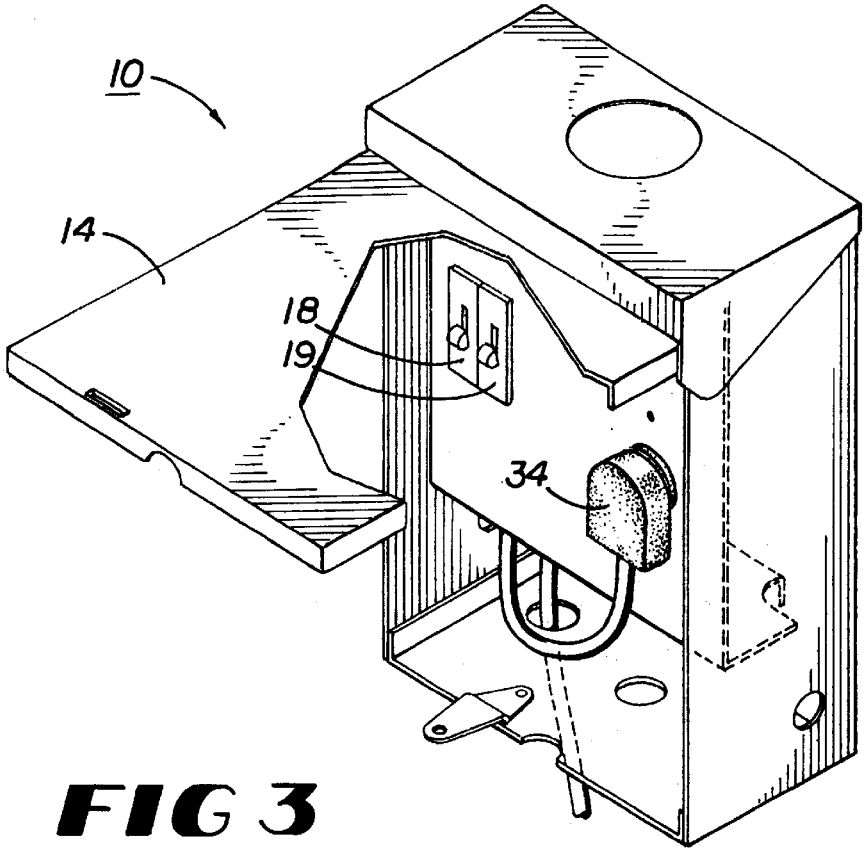
FIG. 3 is a perspective view of the service entrance unit of the present invention in which the load plug is connected to the faceplate receptacle.

The landing lug is electrically connected to one side of the load circuit breaker 19. The other side of the load circuit breaker is electrically connected to a line which has a load plug 34 on the end. The load plug 34 extends from behind the faceplate such that it can be mated with the faceplate receptacle 20, as shown in FIG. 3, to establish an electrical connection to supply utility power to the load. The cover of the service entrance unit can then be closed and locked, if desired.

Figure 4:
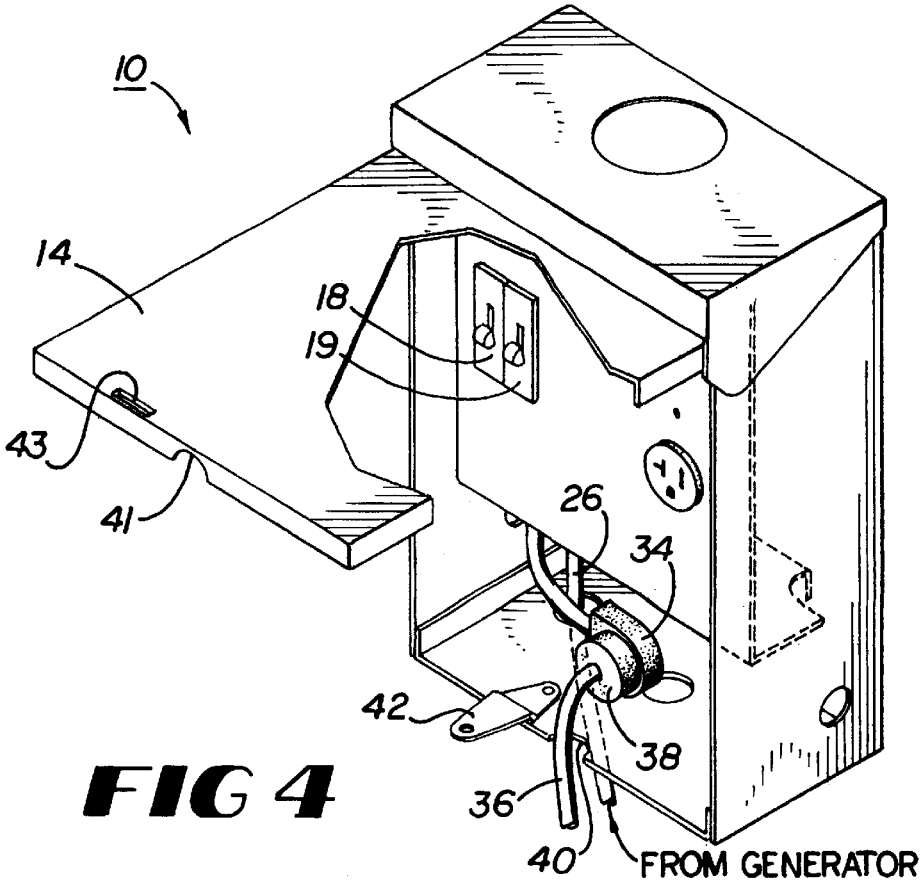
FIG. 4 is a perspective view of the service entrance unit of the present invention in which the load plug is disconnected from the faceplate receptacle and is connected to a generator cord receptacle.

When utility power is interrupted and an alternate power source, such as a generator, is desired to be connected to the load, the cover 14 is opened and the load plug 34 is unplugged from the faceplate receptacle 20 to electrically disconnect the load from utility power. A power cord is routed from a generator, such as a portable generator, that can be positioned in proximity to the service entrance unit. As shown in FIG. 4, the generator power cord 36 has a receptacle 38 on one end that is mated with the load plug 34, which connects generator power to the load without accessing the load.

After the connection is made between the generator cord receptacle 38 and the load plug 34, the connection (i.e., the generator cord receptacle mated with the load plug) is positioned in the generator connection space 22 in the interior of the unit. The cover can then be closed with the generator power cord extending through the aperture defined by corresponding cut outs 40 and 41 on the bottom of the body and the bottom lip of the cover, respectively. The cover can then be secured, if desired, by using a padlock or other suitable locking device in the mating security tabs 42 and 43 extending from the bottom of the body and the cover, respectively. In this manner, the connection of the generator power cord to the load plug, and therefore the generator's electrical connection to the load, is secured within the interior of the service entrance unit.

The present invention preferably is used for 120 volt or 240 volt applications, but can be used for any application in which alternate power is required when utility power is interrupted. The diagrams of FIGS. 5 and 6 show the preferred electrical connections for the present invention for 120 volt and 240 volt applications, respectively. Small changes to the service entrance unit may be required for such 240 volt applications as compared to 120 volt applications, such as providing additional circuit breakers and a different type of receptacle on the faceplate.

The present invention differs from existing service entrance units in that it provides a receptacle on the faceplate for providing a connection point for utility power. This allows a load to be connected and disconnected to utility power by use of a load plug that mates with the receptacle, rather than having to enter the load device to disconnect utility power. Also, the service entrance unit of the present invention provides a connection space in its interior which allows a generator cord receptacle to be mated with the load plug and housed within the space, thereby allowing the cover of the service entrance unit to enclose the connection within the interior of the unit. This provides an environmentally-protected connection and allows the cover of the service entrance to be closed and locked, if desired, thereby providing a secured connection.

Another advantage provided by the present invention is that by removing the load plug from the faceplate receptacle, there is no backfeeding to the utility power grid from the generator.

While the preferred embodiments of the invention have been shown and described, it will be obvious to those skilled in the art that various modifications and alterations can be made thereto without departing from the spirit and scope of the invention as defined in the appended claims.

What is claimed is:

1. A service entrance unit for allowing a load to be connected to utility power or to an alternate power source, comprising:

a body which defines an interior of the unit;

a faceplate in the interior of the unit, wherein said faceplate includes a faceplate receptacle thereon that is electrically connected to utility power;

a space in the interior of the unit, said space being defined between the faceplate and the body;

wherein a load plug, electrically connected to a load line that is electrically connected to the load, is mated with said faceplate receptacle to connect utility power to the load;

wherein the load plug can be disconnected from said faceplate receptacle and connected to an alternate receptacle on a power cord that is electrically connected to an alternate power source external to the unit to connect the alternate power source to the load; and wherein the space is dimensioned to house the mated load plug and alternate power source receptacle.

2. The service entrance unit of claim 1 further comprising a cover hingedly connected to said body for enclosing the interior of the unit, such that the cover can be closed to secure the interior of the unit when the mated load plug and alternate power source receptacle are housed in the space.

3. The service entrance unit of claim 1 wherein the body has at least a bottom, and wherein at least a portion of the faceplate does not extend to the bottom of the body, such that the space is located between the bottom of the body and the faceplate.

4. The service entrance unit of claim 1 wherein the bottom of the body includes a cut out to allow the alternate power source cord to extend therethrough.

5. The service entrance unit of claim 2 wherein the cover includes a cut out to allow the alternate power source cord to extend therethrough when the cover is closed.

6. The service entrance unit of claim 1 wherein the load line enters the interior of the unit via an aperture in the body of the unit.

7. The service entrance unit of claim 1 wherein the utility line enters the interior of the unit via an aperture in the body of the unit.

8. A service entrance unit for allowing a load to be connected to utility power or to an alternate power source, comprising:

a body which defines an interior of the unit;

a faceplate in the interior of the unit, wherein said faceplate includes a faceplate receptacle thereon that is electrically connected to utility power;

a cover hingedly connected to said body for enclosing the interior of the unit;

a space in the interior of the unit, said space being defined between the faceplate and the cover when the cover is closed;

wherein a load plug, electrically connected to a load line that is electrically connected to the load, is mated with said faceplate receptacle to connect utility power to the load;

wherein the load plug can be disconnected from said faceplate receptacle and connected to an alternate receptacle on a power cord that is electrically connected to an alternate power source external to the unit to connect the alternate power source to the load; and wherein the space is dimensioned to house the mated load plug and alternate power source receptacle.

9. A service entrance unit for allowing a load to be connected to utility power or to an alternate power source, comprising:

a body which defines an interior of the unit;

a receptacle mounted in the interior of the unit that is electrically connected to utility power;

a space in the interior of the unit, said space being defined between the receptacle and the body;

wherein a load plug, electrically connected to a load line that is electrically connected to the load, is mated with said receptacle to connect utility power to the load;

wherein the load plug can be disconnected from said receptacle and connected to an alternate receptacle on a power cord that is electrically connected to an alternate power source external to the unit to connect the alternate power source to the load; and wherein the space is dimensioned to house the mated load plug and alternate power source receptacle.

10. A method of disconnecting a load from utility power and connecting the load to an alternate power source at a service entrance unit, comprising the steps of:

opening a cover to the service entrance unit to access the interior of the unit;

disconnecting a load plug, which is electrically connected to the load, from a first receptacle in the interior of the unit, the first receptacle being electrically connected to utility power;

mating the load plug with a second receptacle on a power cord that is electrically connected to an alternative power source external to the unit to connect the alternative power source to the load;

housing the connection of the load plug and second receptacle in a space within the interior of the service entrance unit; and closing the cover of the service entrance unit to secure the connection in the interior of the service entrance unit.

* * * * *